US007350388B2

(12) United States Patent
Honjo et al.

(10) Patent No.: US 7,350,388 B2
(45) Date of Patent: Apr. 1, 2008

(54) METHOD FOR DETERMINING SHAPE OF SHIFT ROLL FOR ROLLING MILL

(75) Inventors: Hisashi Honjo, Chiyoda-ku (JP); Masayoshi Sato, Chiyoda-ku (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 751 days.

(21) Appl. No.: 10/865,802

(22) Filed: Jun. 14, 2004

(65) Prior Publication Data

US 2004/0267392 A1 Dec. 30, 2004

(30) Foreign Application Priority Data

Jun. 27, 2003 (JP) ..... 2003-183805

(51) Int. Cl.
*B21B 39/20* (2006.01)

(52) U.S. Cl. ..... 72/252.5; 72/7.1; 72/10.7; 72/247

(58) Field of Classification Search ..... 72/7.1, 72/7.2, 9.1, 10.7, 11.7, 241.8, 247, 252.5; 700/148, 149, 154
See application file for complete search history.

(56) References Cited

U.S. PATENT DOCUMENTS 4,864,836 A * 9/1989 Ochiai ..... 72/11.7
5,174,144 A * 12/1992 Kajiwara et al. ..... 72/236
5,655,397 A * 8/1997 Satoh et al. ..... 72/241.4
5,950,478 A * 9/1999 Sato et al. ..... 72/247
7,134,307 B2 * 11/2006 Honjo et al. ..... 72/243.6

FOREIGN PATENT DOCUMENTS

| | | |
|---|---|---|
| JP | 55-077903 | 6/1980 |
| JP | 56-030014 | 3/1981 |
| JP | 01-262008 | 10/1989 |
| JP | 07-096307 | 4/1995 |
| JP | 07-232202 | 9/1995 |
| JP | 08-192208 | 7/1996 |
| JP | 2733836 | 3/1998 |

* cited by examiner

*Primary Examiner*—Ed Tolan
(74) *Attorney, Agent, or Firm*—Griffin & Szipl, P.C.

(57) ABSTRACT

A method for determining a shape of a shift roll for a rolling mill, includes the steps of determining a necessary control amount distribution $\alpha_i$ for a plate crown with respect to plate widths, based on a distribution of the number of plates rolled by a target rolling mill with respect to plate widths, and providing a maximum radius difference $y_{A0}$ of the shift roll. The method further includes the steps of preliminarily determining a line $y_i$ of a roll radius distribution with respect to plate widths, based on the necessary control amount distribution $\alpha_i$ and the maximum radius difference $y_{A0}$, shifting the line $y_i$ of the roll radius distribution by a maximum roll shift to obtain a distribution $\Delta y_{Bi}$ of a roll gap change amount with respect to plate widths under the maximum roll shift, and smoothing sharp local changing part of the distribution $\Delta y_{Bi}$ of the roll gap change amount.

3 Claims, 6 Drawing Sheets

FIG.8A small width plate
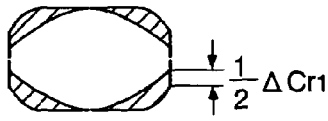
FIG.8B middle width plate
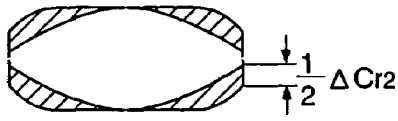
FIG.8C large width plate
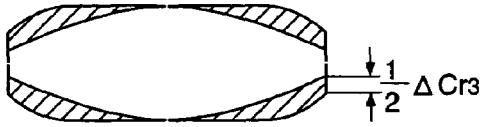
FIG.8D
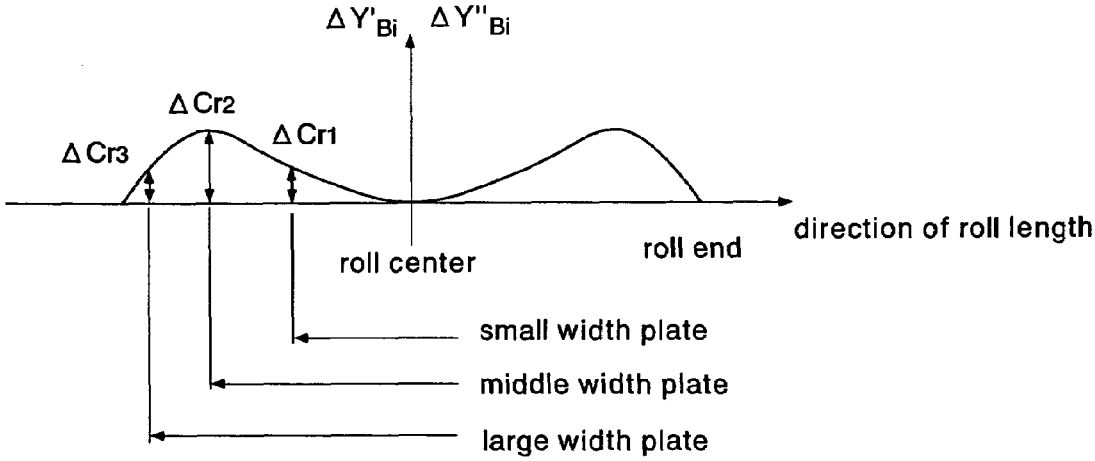

METHOD FOR DETERMINING SHAPE OF SHIFT ROLL FOR ROLLING MILL

This application claims priority from Japanese Patent Application No. 2003-183805, filed Jun. 27, 2003, the entire disclosure of which is incorporated herein by reference.

BACKGROUND OF THE INVENTION

1. Field of the Invention

The present invention relates to a method for determining a shape of a shift roll for a rolling mill. The shift roll is used by the roll-shift type rolling mill that rolls a plate material while shifting an upper work roll and a lower work roll to be displaced from each other in the axial directions.

2. Description of the Related Art

Conventionally, when a plate is rolled, a change (referred to as a plate crown) of a thickness of the plate becomes large in a width direction of the plate due to warping of the roll. To control and reduce the change of the thickness of the plate, the roll is made to have a certain shape, and the roll is shifted so that a distribution of a plate thickness in the width direction can be controlled (for example, see References 1 through 7).

In this specification, the plate crown is defined by the following equation (1):

Cr=hc−he, where "Cr" designates a plate crown, "hc" designates a plate thickness of a center in the width direction, and "he" designates a plate thickness of an edge in the width direction.

Reference 1 discloses an upper shift roll and a lower shift roll that have complementary shapes to each other, and each complementary shape is expressed by the equation (2):

$$r(x)=a+bx+cx^2+dx^3+ex^4+fx^5,$$

where "r" designates a radius of the roll, and "x" designates a position in the axial direction.

Reference 2 discloses a shift work roll having a shape curved over an entire length of the roll body. The outline curve of the roll shape is expressed by a mathematical equation such as a polynomial function and a trigonometric function.

Reference 3 discloses a point symmetry shift roll that is expressed by a quadratic function or trigonometric function, and is used for controlling a roll gap between the rolls.

Reference 4 discloses a work roll that has a tapered part, and is shifted.

According to References 1 through 3, a shape of the shift rolls is expressed by a certain function. According to Reference 4, the tapered part that is formed at an end of the shift roll body, and an end part of a plate in the width direction is pressed by the tapered part to control a thickness distribution of the plate in the width direction.

Meanwhile, Reference 5 discloses a technique in which a roll body is divided into a main crown control area and a sub-crown control area, a roll curve is made large in the main crown control area, and a roll curve is made small in the sub-crown control area.

Reference 6 discloses a technique in which the curve of the shift roll of Reference 5 is modified such that a radius of one end of the shift roll becomes equal to a radius of the other end of the shift roll.

According to References 5 and 6, the shift roll is shaped to be effective in the crown control without being limited to a specific function. In the process of shaping the shift roll in References 5 and 6, a distribution of the number of plates rolled by a target rolling mill with respect to plate widths is divided into the particularly important plate width area and the less important plate width area. By taking into account the particularly important plate width area and the less important plate width area, a curve of the shift roll is determined through a trial-and-error procedure.

Since the distribution of the number of plates rolled by the target rolling mill with respect to plate widths is generally a numerical value distribution, it requires a troublesome work to divide the distribution of the number of plates rolled by the target rolling mill into the main crown control area and the sub-crown control area, and obtain an optimum roll crown shape through a trial-and-error procedure. Thus, it is difficult to obtain an optimum roll crown shape. Accordingly, a process is needed of determining a shape of a shift roll through numerical processing based on the numerical distribution of the number of plates rolled by a target rolling mill with respect to plate widths.

Reference 7 discloses a rolling mill that shifts a shift roll in which a shape of a shift roll copes with rolling defectiveness due to warping of the roll, a heat crown of a roll and a local surface pressure of a roll. However, the technique of Reference 7 is inconvenient because how to combine the technique of Reference 7 with the technique of References 5 and 6 is unknown.

[Reference 1] Japanese Examined Patent Publication No. 7-102377

[Reference 2] Japanese Patent No. 2733836.

[Reference 3] Japanese Examined Patent Publication No. 63-62283

[Reference 4] Japanese Examined Patent Publication No. 60-51921

[Reference 5] Japanese Patent No. 3317311

[Reference 6] Japanese Patent No. 3348503

[Reference 7] Japanese Laid-Open Patent Publication No. 8-192208

Conventionally, a shape of a shift roll is defined by a mathematical function. Since a plate thickness distribution in the width direction is changed depending on a plate width, it is necessary to increase an effect of the plate crown control for a width of a frequently rolled plate. Accordingly, instead of a curved shape of a shift roll fixed by a mathematical function, it is necessary to develop a method of shaping a shift roll by taking into account a distribution of the number of plates rolled by a target rolling mill with respect to plate widths. Further, it is desired that this method is not a mere trial-and-error procedure, but a procedure performed step by step.

SUMMARY OF THE INVENTION

In order to satisfy the above desires, the present invention was made. It is an object of the present invention to provide a method for determining a shape of a shift roll for a rolling mill, by which the shape of the shift roll can be determined by taking into account a numerical value distribution of the number of plates rolled by the target rolling mill with respect to plate widths, without using a trial-and-error procedure.

According to the present invention, there is provided a method for determining a shape of a shift roll for a rolling mill, comprising: a first step of determining a necessary control amount distribution $\alpha_i$ for a plate crown with respect to plate widths, based on a distribution of the number of plates rolled by a target rolling mill with respect to plate widths; a second step of providing a maximum radius difference $y_{A0}$ of the shift roll; a third step of preliminarily determining a line $y_i$ of a roll radius distribution with respect to plate widths, based on the necessary control amount distribution $\alpha_i$ and the maximum radius difference $y_{A0}$; a fourth step of shifting the line $y_i$ of the roll radius distribution by a maximum roll shift to obtain a distribution $\Delta y_{Bi}$ of a roll gap change amount with respect to plate widths under the maximum roll shift; and a fifth step of smoothing sharp local changing part of the distribution $\Delta y_{Bi}$ of the roll gap change amount.

According to another aspect of the present invention, the method for determining the shape of the shift roll for the rolling mill, further comprises: a sixth step of rotating the entire line $y_i$ of the roll radius distribution such that a radius of one end of a roll body becomes equal to a radius of the other end of the roll body; and a seventh step of grinding a shift roll material to make the shift roll expressed by the rotated line $y_i$ of the roll radius distribution of the sixth step.

According to another aspect of the present invention, the method for determining the shape of the shift roll for the rolling mill, further comprises an eighth step of re-obtaining a distribution $\Delta y_{Bi}$ of a roll gap change amount with respect to plate widths under the maximum roll shift, based on the rotated line $y_i$ of the roll radius distribution of the sixth step, and when the re-obtained distribution $\Delta y_{Bi}$ of the roll gap change amount has an unnatural convex or concave, modifying the rotated line $y_i$ of the roll radius distribution of the sixth step.

When grinding the shift roll material, position coordinate values of the modified rotated line $y_i$ of the roll radius distribution are read to be set in a grinding machine so that the shift roll having the outline expressed by the modified rotated line $y_i$ of the roll radius distribution can be formed.

By performing the above steps, the curve of the shift roll is determined based on the distribution of the number of plates rolled by the target rolling mill with respect to plate widths. Accordingly, it is possible to determine an optimum roll curve in accordance with a distribution of plates rolled by a rolling mill of a user with respect to plate widths.

Furthermore, the curved roll shape is determined such that a radius difference of the shift roll stays within a predetermined value. Thereby, it is possible to suppress rolling vibration that can be caused by a radius difference.

Other objects and advantages of the present invention will become apparent from the following detailed description with reference to the drawings.

BRIEF DESCRIPTION OF DRAWINGS

FIGS. 8A, 8B, 8C and 8D show roll gap change distributions that do not take into account a distribution of the number of plates rolled by a target rolling mill with respect to plate widths.

DESCRIPTION OF THE PREFERRED EMBODIMENTS

In the following, an embodiment of the present invention will be described with reference to the attached drawings.

Before starting a process, a roll gap control amount $\Delta y'B$ desired by an operator who operates a rolling mill is determined.

A desired change amount $\Delta y''_{Bi}$ of a roll gap is determined in the following manner, for example.

It is assumed that when a plate having a small width of FIG. 8A, a plate having a middle width of FIG. 8B and a plate having a large width of FIG. 8C are being rolled, a change of a plate thickness in the width direction of each of these plates is shown by the oblique lines of FIGS. 8A, 8B and 8C. On this assumption, it becomes necessary to control and change a roll gap by $\Delta C_{r1}$ for the plate having the small width, a roll gap by $\Delta C_{r2}$ for the plate having the middle width, and a roll gap by $\Delta C_{r3}$ for the plate having the large width. As shown in FIG. 8D, a curved line passing through the positions corresponding to $\Delta C_{r1}$, $\Delta C_{r2}$, and $\Delta C_{r3}$ becomes the desired change amount of a roll gap. Since the hardness of the plate is taken into account, a ratio of a value $\Delta C$ and the control amount is not 1:1. Accordingly, the curved line of $\Delta y'_{Bi}$ is magnified or reduced. In other words, $\Delta y'_{Bi}$ is multiplied by a ratio $\beta$ of the roll hardness to a plate hardness to use $y''_{Bi}$ equal to $\beta \cdot \Delta y'_{Bi}$ for comparison with $\Delta y_{Bi}$ at Step S10 (described later) in the method of the embodiment of the present invention.

$\Delta y''_{Bi}$ is a desired value simply expressing a crown control amount with respect to plate widths without taking into account a weight of a distribution of the number of plates rolled by a target rolling mill with respect to plate widths. Instead of the complex calculation of FIG. 8D, $\Delta y''_{Bi}$ may be simply given as a fixed value (μm) that is a desired crown control amount regardless of a width size.

Figure 1:
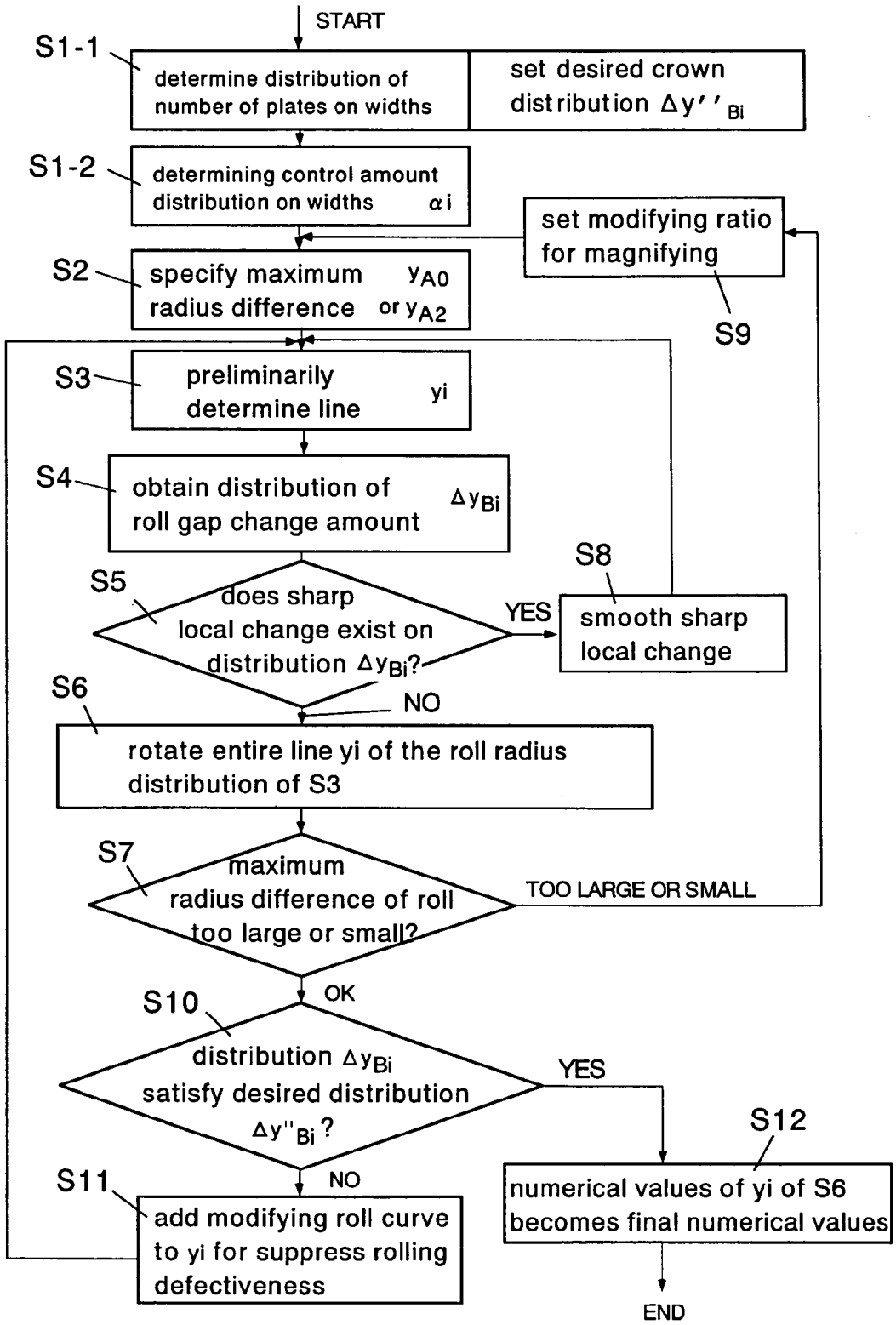
FIG. 1 is a flowchart showing a method for determining an optimum shape of a shift roll.
Figure 2:
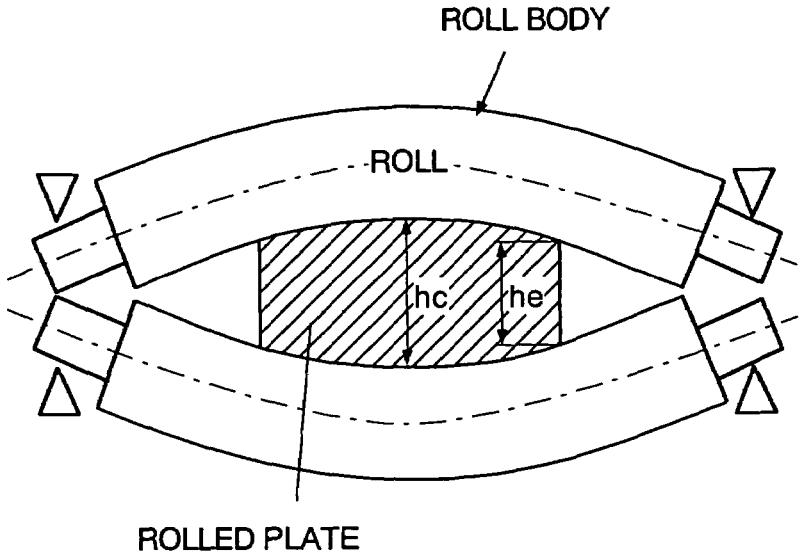
FIG. 2 shows a plate thickness distribution in a plate width direction.

FIG. 1 is a flowchart showing a method of determining a shape of a shift roll according to the embodiment of the present invention. First, for the target rolling mill, a distribution line $P_i$ of a distribution of the number of plates rolled by the target rolling mill with respect to plate widths. The distribution line $P_i$ is not necessarily a continuous line, and may be collection of values of points corresponding to plate widths $B_i$, and may be a polygonal line. Corresponding to the distribution line $P_i$, a distribution line of a plate crown control necessity index $\alpha_i$ is formed. When the crown control necessity and the number of rolled plates are directly associated, a shape of the distribution line of the crown control necessity index $\alpha_i$ becomes equal to the shape of the distribution line Pi of the number of rolled plates. However, when more importance is placed on the plate crown control for a certain plate width, the value of $\alpha_i$ at this plate width is increased. For example, as shown by the dotted line of FIG. 3, the distribution of the crown control necessity index $\alpha_i$ is displaced from the distribution Pi of the number of plates rolled by the target rolling mill with respect to plate widths. The maximum radius difference of the curved roll is given as a specified value $y_{A0}$ at Step S2.

Based on the distribution of the number of plates rolled by the target rolling mill with respect to plate widths, the plate crown control necessity index $\alpha_i$ is determined so as to satisfy the equation: $\Sigma\alpha_i=1.0$, where $\alpha_i$ is an integer no less than 1 and no more than MAXR). Based on the determined index $\alpha_i$ and the specified value $y_{A0}$, the roll radius $y_i$ at the point separated from the center of the roll body toward the end of the roll body by a distance $x_i$ is obtained by the following equation (3):

$$y_i=\alpha_i \cdot y_{A0}+y_{i-1}$$

where $y_1=0$.

Figure 3:
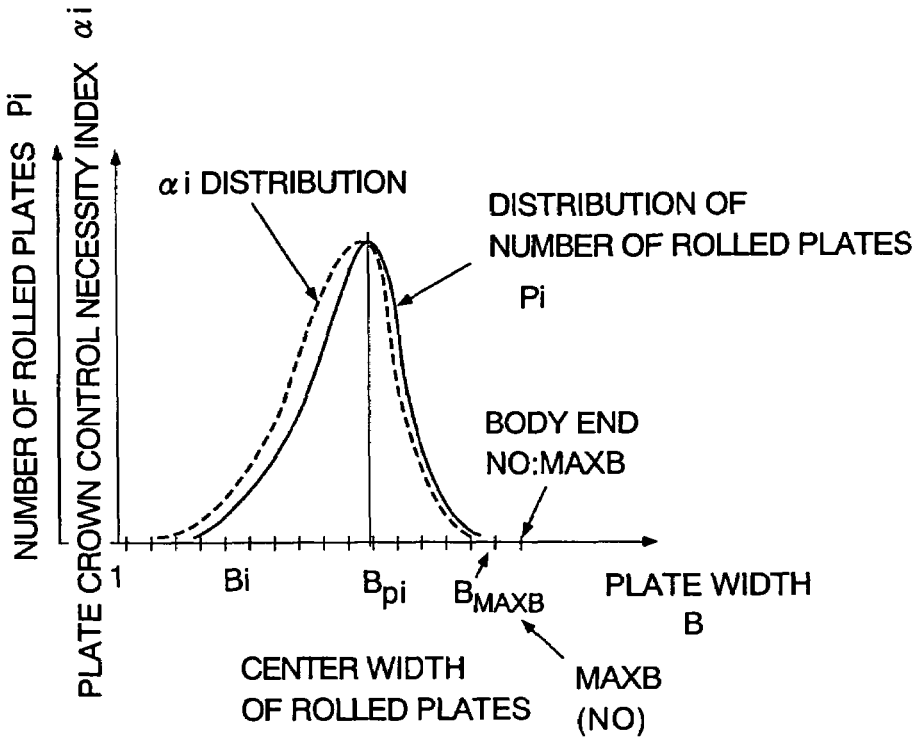
FIG. 3 shows a plate crown, a plate crown control necessity index, and a distribution of the number of plates rolled by a target rolling mill with respect to plate widths.
Figure 4:
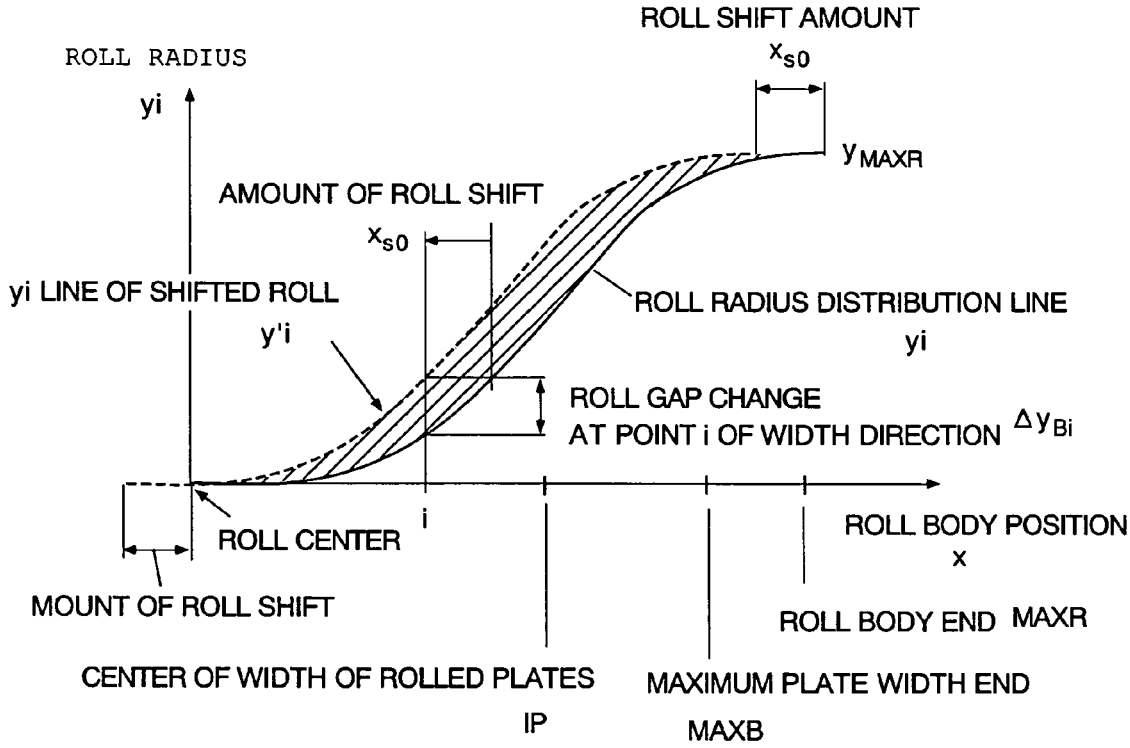
FIG. 4 shows a radius of a roll and a radius of the shifted roll.

For example, based on the plate crown control necessity index $\alpha_i$ shown in FIG. 3, the roll radius $y_i$ shown in FIG. 4 is obtained. A distribution line $y'_i$ of the roll radius in a state where the roll is shifted is expressed by the following equation (4):

$$y'_i=y_{(i-Ns)},$$

where Ns designates the number of divisions in the axial direction that correspond to a shift amount xs0.

Accordingly, a roll gap change amount $\Delta y_{Bi}$ at the point i by the shift of the one roll is expressed by the following equation (5):

$$\Delta y_{Bi}=y'_i-y_i=y_{(i-Ns)}-y_i.$$

Figure 5:
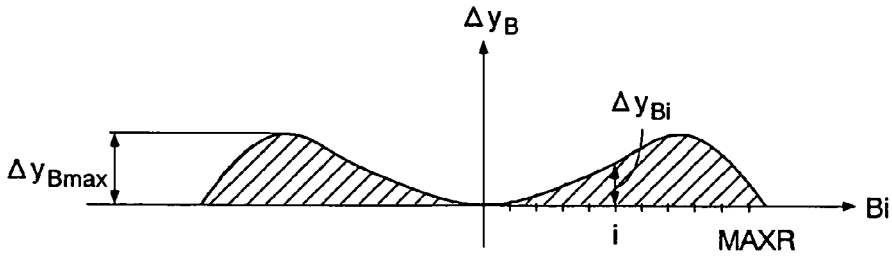
FIG. 5 shows a change amount of a roll gap due to roll shift.

The area indicated by the oblique lines of FIG. 4 is the roll gap change amount at the right half of the one roll by the roll shift. At Step S4 of the flowchart shown in FIG. 1, the roll gap change amount $\Delta y_B$ of the vertical axis of FIG. 5 is obtained. The roll gap change amount $\Delta y_B$ becomes a roll crown change for the plate crown control. When convex and concave parts are locally generated on the line of the roll gap change amount $\Delta y_B$ of FIG. 5, the value of $\alpha_i$ determined at Step S1-2 or the value of $y_i$ determined at Step S3 is locally modified at Step S5 and Step S8.

The distribution of the number of plates rolled by the target rolling mill with respect to plate widths depends on a purchaser of the rolling mill, and is not necessarily expressed by a smooth mathematical function.

The roll is shaped such that the left half and the right half of the roll outline are symmetric with respect to a point. The left side part and the right side part of the upper roll are symmetric to the right side part and the left side part of the lower roll, respectively. The upper roll and the lower roll are shifted in opposite directions.

Figure 6:
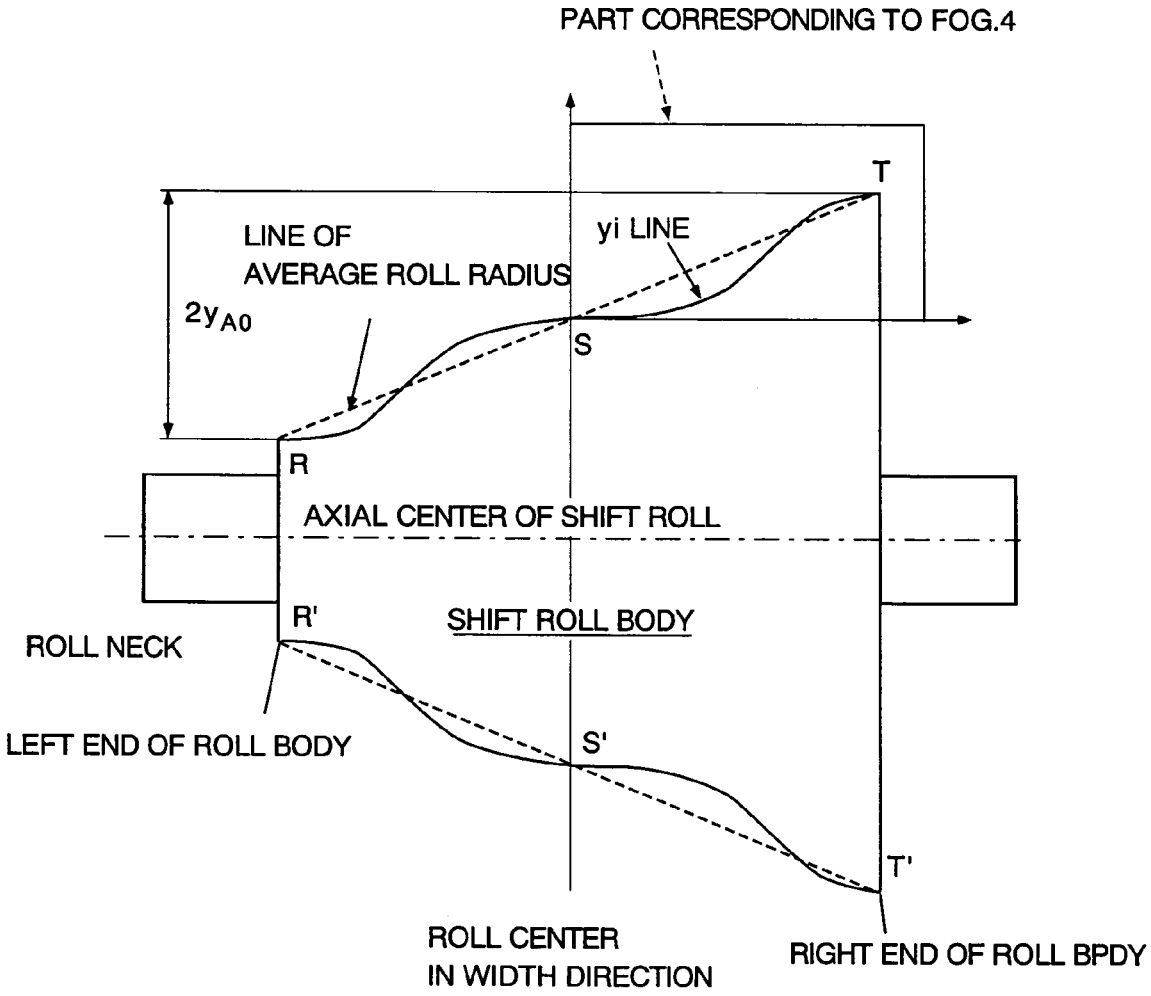
FIG. 6 shows a plate crown control roll.

The roll radius $y_i$ of FIG. 4 is applied to the entire roll to obtain an entire shape of the roll shown in FIG. 6. The straight dotted line R-S-T extending from the left end to the right end of the roll is the inclined line from the one side to the other side of the roll body. The height difference between the point R and the point T becomes $2y_{A0}$.

Figure 7:
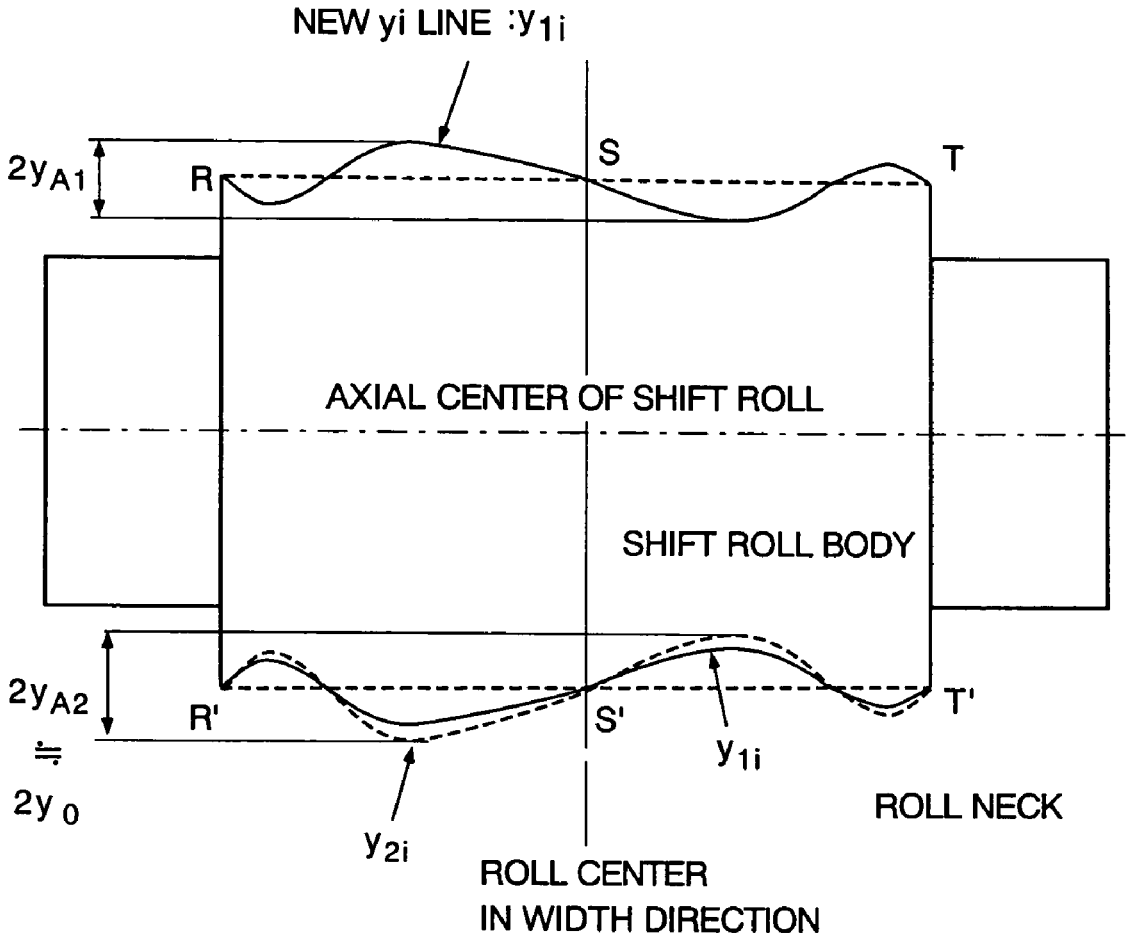
FIG. 7 shows a modified shape of the roll.

The shape shown in FIG. 6 is effective in shaping a plate crown control roll. Meanwhile, as mentioned in Reference 6, when a roll radius difference of the roll body is large, vibration is more frequently generated. Accordingly, for suppressing vibration, it is preferable to make a roll radius difference small. For this reason, at Step S6, the inclined straight lines R-S-T and R'-S'-T' shown in FIG. 6 are modified to the line parallel to the roll axis as shown in FIG. 7. Thus, the solid line $y_i$ of FIG. 6 is modified to be the solid line y1i of FIG. 7 passing through the points R, S and T. In this modifying manner, without largely changing the plate crown control amount, it is possible to obtain a roll shape having a small roll radius difference.

The new roll radius difference obtained at Step S6 becomes the difference $2y_{A1}$ between the top point and the bottom point of the new line $y_{1i}$. When the roll radius difference $2y_{A1}$ is too larger or too smaller than the specified allowable maximum roll radius difference $2y_{A0}$, the new line y1i is magnified or reduced to form a similar line $y_{2i}$ shown by the dotted curved line of the lower part of FIG. 7 that is modified from the new line $y_{1i}$. At this time, the magnifying or reducing ratio $y_{A0}/y_{A1}$ may be used as the first approximate ratio, but the appropriate magnifying ratio or reducing ratio close to the ratio $y_{A0}/y_{A1}$ is then used for gradually modifying the line. In this manner, Step S9 is performed.

By performing the process at Step S6, the amount of the entire $\Delta y_{Bi}$ is changed, but this changed amount is small, and is approximately constant in the plate width direction, so that the $\Delta y_{Bi}$ determined at Step S4 is not modified. Further, by a repeat flow described later, $\Delta y_{Bi}$ is calculated again, so that an error due to Step S6 can be decreased.

By the repeat process, a roll shape y1i is determined. Based on the distribution of the number of plates rolled by the target rolling mill with respect to plate widths, the above processes are performed on the condition that the plate crown control amount corresponding to $\Delta y_{Bi}$ of FIG. 5 stays within the allowable value for the roll radius difference $2y_{A0}$.

When the maximum radius difference of the roll body is not too larger or too smaller than the allowable maximum radius difference at Step S7, the process proceeds to Step S10 where it is determined whether or not one or several of points of $\Delta y_{Bi}$ in the width direction approximately satisfy the desired upper limit values of the corresponding points of $\Delta y''_{Bi}$. When one or several points of $\Delta y_{Bi}$ in the width direction approximately satisfy the desired upper limit values of the corresponding points of $\Delta y''_{Bi}$, the process is finished. On the other hand, when one or several points of $\Delta y_{Bi}$ in the width direction does not satisfy the upper limit values of the corresponding points of desired $\Delta y''_{Bi}$, a modifying amount as mentioned in Reference 7 is added to $y_i$ to produce new $y_i$. The distribution of this modifying amount is not necessarily point-symmetric between the left part and the right part of the roll. In other words, by adding the modifying amount, shapes of the upper and lower rolls does not complement each other. When the modifying amount is added to $y_i$, $y_{Bi}$ is calculated again to make one point of $y_i$ close to the upper limit value of the corresponding point of desired $\Delta y''_{Bi}$.

FIG. 8D shows the distribution line of change amounts of a roll gap without taking into account the distribution of the number of plates rolled by the target rolling mill with respect to plate widths. The process at Step S11 that is the modifying process for Step S10 is finished when one, two or three important points reach the upper limit that is the point on the curved line of FIG. 8D. However, the distribution shape of $\Delta y_{Bi}$ that places importance on the distribution of the number of plates rolled by the target rolling mill with respect to plate widths is adequately maintained as a basic shape. In other words, the shape of $\Delta y_{Bi}$ is not made to conform to the shape of FIG. 5, but Step S10 determine whether or not a few points of $\Delta y_{Bi}$ reach the upper limits of $\Delta y''_{Bi}$ that are points on the curved lone of FIG. 8D to judges whether or not $\Delta y_{Bi}$ satisfy the desired value.

$y_i$ when $\Delta y_{Bi}$ satisfies the desired value at Step S10 becomes the roll radius.

This roll radius $y_i$ is collection of numerical values, and based on the numerical value collection, the roll shape that is as close to the shape represented by $y_i$ as possible is formed by a roll grinding machine.

According to the present invention, the following advantages can be obtained.

First, the present invention can provide a method for determining an optimum shape of a shift roll, so that it is not necessary to obtain a roll shape through an error-and-trial procedure.

Secondly, the present invention can provide a method for optimizing a shape of a shift roll corresponding to the distribution of the number of plates rolled by the target rolling mill that can be expressed by numerical values, but is difficult to express by a mathematical function. Furthermore, in the optimizing process, the radius difference of the roll can be maintained to be small.

Thirdly, the method of the present invention can cope with rolling defectiveness due to a heat crown, roll warping, and a local surface pressure of a roll.

Accordingly, the method for determining a shape of a shift roll for a rolling mill according to the present invention has an excellent advantage in that the shape of the shift roll can be determined by taking into account a numerical value distribution of the number of plates rolled by the target rolling mill with respect to plate widths, without using a trial-and-error procedure.

What is claimed is:

1. A method for determining a shape of a shift roll for a rolling mill, comprising:

a first step of determining a necessary control amount distribution $\alpha_i$ for a plate crown with respect to plate widths, based on a distribution of the number of plates rolled by a target rolling mill with respect to plate widths;

a second step of providing a maximum radius difference $y_{A0}$ of the shift roll;

a third step of preliminarily determining a line $y_i$ of a roll radius distribution with respect to plate widths, based on the necessary control amount distribution $\alpha_i$ and the maximum radius difference $y_{A0}$;

a fourth step of shifting the line $y_i$ of the roll radius distribution by a maximum roll shift to obtain a distribution $\Delta y_{Bi}$ of a roll gap change amount with respect to plate widths under the maximum roll shift; and a fifth step of smoothing sharp local changing part of the distribution $\Delta y_{Bi}$ of the roll gap change amount.

2. The method for determining the shape of the shift roll for the rolling mill according to claim 1, further comprising:

a sixth step of rotating the entire line $y_i$ of the roll radius distribution such that a radius of one end of a roll body becomes equal to a radius of the other end of the roll body; and a seventh step of grinding a shift roll material to make the shift roll expressed by the rotated line $y_i$ of the roll radius distribution of the sixth step.

3. The method for determining the shape of the shift roll for the rolling mill according to claim 2, further comprising:

an eighth step of re-obtaining a distribution $\Delta y_{Bi}$ of a roll gap change amount with respect to plate widths under the maximum roll shift, based on the rotated line $y_i$ of the roll radius distribution of the sixth step, and when the re-obtained distribution $\Delta y_{Bi}$ of the roll gap change amount has an unnatural convex or concave, modifying the rotated line $y_i$ f the roll radius distribution of the sixth step.

* * * * *